US011712594B2

(12) United States Patent
Gvoich

(10) Patent No.: US 11,712,594 B2
(45) Date of Patent: Aug. 1, 2023

(54) DUAL BALANCE ADJUSTABLE SPRING TOWER APPARATUS AND METHOD OF USING SAME

(71) Applicant: GVOICH FITNESS SYSTEMS, Baton Rouge, LA (US)

(72) Inventor: William Gvoich, Baton Rouge, LA (US)

( * ) Notice: Subject to any disclaimer, the term of this patent is extended or adjusted under 35 U.S.C. 154(b) by 8 days.

(21) Appl. No.: 17/238,875

(22) Filed: Apr. 23, 2021

(65) Prior Publication Data

US 2021/0283451 A1 Sep. 16, 2021

Related U.S. Application Data

(63) Continuation-in-part of application No. 16/816,855, filed on Mar. 12, 2020, now abandoned.

(51) Int. Cl.

| | |
|---|---|
| ***A63B 21/02*** | (2006.01) |
| ***A63B 21/00*** | (2006.01) |
| ***A63B 21/04*** | (2006.01) |

(52) U.S. Cl.

CPC ..... *A63B 21/023* (2013.01); *A63B 21/00061* (2013.01); *A63B 21/00065* (2013.01); *A63B 21/0428* (2013.01); *A63B 21/154* (2013.01)

(58) Field of Classification Search

CPC .. A63B 21/00058–00065; A63B 21/02; A63B 21/023–025; A63B 21/04–0407; A63B 21/0428; A63B 21/0442; A63B 21/055–0557; A63B 21/062; A63B 21/0626–0628; A63B 21/0632; A63B 21/08; A63B 21/15–154; A63B 21/4043; A63B 21/4035; A63B 21/156; A63B 2017/0652; A63B 23/03541

See application file for complete search history.

(56) References Cited

U.S. PATENT DOCUMENTS

| | | | | |
|---|---|---|---|---|
| 4,747,594 | A * | 5/1988 | Houde | A63B 21/1681 482/904 |
| 6,120,425 | A * | 9/2000 | Endelman | A63B 23/03525 482/142 |
| 7,537,554 | B2 * | 5/2009 | Zhuang | A63B 21/04 482/121 |
| 8,348,816 | B2 * | 1/2013 | Gerschefske | A63B 21/04 482/133 |
| 9,050,497 | B2 * | 6/2015 | Reyes | A63B 21/062 |
| 9,211,440 | B2 * | 12/2015 | Lagree | A63B 21/00 |
| 9,802,075 | B2 * | 10/2017 | Gvoich | A63B 21/0628 |
| 10,518,125 | B2 * | 12/2019 | Janowski | A63B 22/0076 |
| 2002/0058573 | A1 * | 5/2002 | Endelman | A63B 21/023 482/142 |
| 2021/0106864 | A1 * | 4/2021 | Duong | A63B 21/023 |

* cited by examiner

*Primary Examiner* — Garrett K Atkinson
*Assistant Examiner* — Kathleen M Fisk
(74) *Attorney, Agent, or Firm* — Ted M. Anthony; Sarah B. Dupont

(57) ABSTRACT

The present invention pertains to a spring resistance exercise machine including an adjustable spring carriage and anchor housing and having cable and pulley linkage assemblies attached to a plurality of springs, or other resistance sources. Each cable and pulley linkage assembly, which is independent of the other(s), can be used unilaterally (by one arm or one leg at a time) or bilaterally (by both arms or both legs at a time) during exercise resistance training (that is, training in which both limbs of a pair are used to simultaneously pull a certain resistance).

8 Claims, 7 Drawing Sheets

DUAL BALANCE ADJUSTABLE SPRING TOWER APPARATUS AND METHOD OF USING SAME

CROSS REFERENCES TO RELATED APPLICATION

This application is a continuation-in-part of application Ser. No. 16/816,855, filed Mar. 12, 2020, incorporated herein by reference, currently pending.

STATEMENTS AS TO THE RIGHTS TO THE INVENTION MADE UNDER FEDERALLY SPONSORED RESEARCH AND DEVELOPMENT

None

BACKGROUND OF THE INVENTION

1. Field of the Invention

The present invention pertains to a spring resistance exercise machine. More particularly, the present invention pertains to an exercise assembly having a multi-cable and pulley linkage system attached to a plurality of springs, or other resistance means, and attached to a biofeedback system. More particularly still, the present invention pertains to a Dual Balance (DB) Adjustable Spring Tower assembly, or an exercise assembly, that can be used alongside other Pilates' equipment, although it can be used equally in other exercise settings that incorporate strength training equipment.

2. Brief Description of the Prior Art

"Pilates" is a popular exercise method founded by Joseph Pilates. The primary exercise apparatus used by Pilates practitioners is the Pilates Reformer. It consists of a frame, which houses a moveable carriage that a trainee would usually lie on, in a supine, side or prone position, and sits or kneels on to perform a variety of exercise movements.

Steel springs attached to a spring bar and the moveable carriage provide resistance for each exercise, as the trainee pushes on the foot bar, or pulls on the ropes which are also attached to the carriage. The steel springs are typically color coded to indicate resistance level.

The Specificity of Training Principle states that strength training affects both the muscular system and the nervous system. The closer the exercise movement resembles the real-life movement and the body position of that movement, the greater the transfer of training benefits from the exercise to the real life movement, not only in strength but also in stability, function, and muscle coordination. For example, in order to strengthen the leg muscles for a real life activity, such as a squat motion, a standing squat exercise will result in a greater "carry over" effect when compared to a supine leg press performed on a moveable carriage of the Pilates Reformer.

Some of the guiding principles of Pilates training are to engage and strengthen the body's core, to train the body as one integrated unit, to improve strength, balance and stability, to improve physical function to help the trainee to perform real-life tasks with more efficiency, and to improve body awareness through mindful training.

Most real-life activities, especially when muscular force is activated to carry out "strength-specific tasks," are done from a standing position. The standing position provides increased core bracing in the abdominal, low back, and hip areas, creating greater body stability and force output during physical exertion. Exercises done from a standing position prepare the trainee for more advanced body stabilization, an increase in real-life functional strength, and full body integration of muscles working in coordination during physical exertion. Moreover, people that have difficulty sitting, kneeling, crossing their legs, etc., need an alternative body position for exercise. Standing is the better option. As such, exercises done from a lying, sitting or kneeling position on a Pilates Reformer are not as beneficial or transfer as well to real-life movements done from a standing position.

One result of this design drawback in the Pilates Reformer was to provide Pilates' practitioners with complementary equipment, to perform Pilates based exercises from a standing position. For example, one such common complementary apparatus, which is mounted on the Reformer, is called the Tower. Versions of the Tower can also be free-standing or wall mounted units. Manufacturers of Pilates equipment (for example, Balanced Body and Merrithew), produce wall mounted versions of the Tower called the Pilates Springboard™, and the Spring Wall™.

All versions of the Tower, the Pilates Springboard™ and the Spring Wall™ use steel springs as the preferred resistance means. Joseph Pilates used springs in his original inventions and Pilates purists still advocate steel springs as the resistance means for several reasons:

1) Females are the main participants in Pilates training.
2) Joseph Pilates' early success was in training injured dancers. Pilates training has been credited as a method of developing a dancer's body with long, lean muscles.
3) Pilates has always marketed strength training with steel springs as the best method of strengthening muscles, without the "bulk", which is normally associated with weight-lifting.
4) Women generally are intimidated by free-weights and exercise machines with weight stacks. Most women truly believe that they will become "bulky" with weight training.
5) They want long, lean muscles—"a dancer's body."
6) Springs have a cushioning effect on the joints and therefore create less wear and tear on the musculoskeletal system over a period of time.

The Pilates Tower, the Pilates Springboard™ and the Spring Wall™ use similar methods of providing spring resistance for their trainees. They have at least two springs (normally called "regular" or "short") for the upper body—one for each arm—and they have at least two springs (normally called "long") for the legs. The springs come in pairs, with each pair having the same resistance. They need "longer" springs for the legs because the range of exercise motion is much greater compared to the upper body movements. The "short" springs would "overstretch", negatively affecting exercise technique, resistance placed on the working muscles, spring resilience, longevity of the springs, and equipment "ease of use" during exercise. The springs are color coded to indicate their resistance level, for example, "yellow" to indicate light resistance.

One problem is that this single starting spring resistance (one for each limb) is not suitable for all of the different strength levels of the new trainees, especially for men; but also, for women who vary greatly in terms of starting strength. For some, the starting resistance is too light, for others it is too heavy. Furthermore, when these same springs are used continually over an extended period of time, there is no noticeable improvement in strength. The primary reason for this is, that in order for the muscles to become stronger, there has to be a gradual increase in "stimulus" which forces the muscles to adapt to the new workload by becoming stronger. There has to be a light "progressive resistance" placed on the working muscles in order to enable the body to adapt to the new workload and enable the trainee to maintain proper exercise technique.

One solution used by Pilates' manufacturers is to provide more springs, with a greater tension to increase the resistance. For example, they provide two (2) additional springs with greater resistance for the upper body (one for each arm) and two (2) longer springs for the lower body (one for each leg). It is to be noted that a major drawback to this approach is that the different muscle groups vary in their ability to produce force. Some muscles are weaker, other muscles are stronger, and the additional springs with greater resistance cannot address the varying strength capabilities of different muscle groups and the strength variances of different individuals. Also, the resistance progression with the new springs is too much for most trainees, especially women.

The springs are attached individually (one for each limb) to spring hooks or anchor points, vertically on two columns or on a frame. The problem with this design is evident when the springs are stretched horizontally in many exercises. The trainee has to be at least a "spring length" away from the frame in order to create starting tension in the spring(s). This takes up a lot of extra space in the immediate exercise area. Moreover, when the trainee needs the spring(s) to be stretched horizontally and vertically during certain exercise movements, for example in lying supine leg exercises, there are "dead spots" (no tension) in the spring(s). When there is no additional tension placed on the working muscles, there are no strength benefits. The trainee encounters the same problem of no tension in certain parts of the exercise movement, when he or she has to be positioned near the frame in order to start the exercise.

The drawback with this spring resistance design is that it does not provide for sufficient "gradual" resistance progressions needed to enhance potential strength or address the vast differences in strength of different individuals. One consistent resistance will not increase strength. Even two to three progressions do not meet the minimum requirements of real-life strength that can be acquired through "progressive" resistance training. A further drawback with this spring resistance design is that there is a need for two (2) pairs of springs to train the body—one (1) pair of "short" springs for upper body movements and one (1) pair of "long" springs for lower body movements.

The "one size fits all" resistance training system is the opposite of the principal concept that every person has unique physical attributes and the resistance means should match the individual's starting level of ability; and then with gentle progressions stimulate the muscles to adapt to the progressive overload. The training results are stronger muscles and increased functional strength for real-life activities.

Assuming that all types of resistance training equipment are available for selection, the following criteria for selecting equipment should be considered:

1. Effectiveness in training the "target" muscle groups or movement.
2. Safety.
3. Convenience (ease of use).

The most important criteria is effectiveness; that is how well the equipment allows specific exercises to be performed.

In order to measure the effectiveness of the resistance means (steel springs or cables) and the equipment design, the role of the strength curve must be considered. The definition of strength curve: the force or tension developed by a muscle contraction during an exercise movement varies with changes in muscle length. The variation in strength (force developed by a muscle contraction) through a range of an exercise movement is called a "strength curve."

To further measure the effectiveness of the resistance means (steel springs or cables) and the equipment design, the role of the resistance curve and the relationship between the strength curve and the resistance (tension) curve must be considered. The definition of resistance curve: the amount of tension being applied by the resistance means (springs) to the working muscles through the full range of the exercise movement is called the resistance curve.

Matching the Strength Curve: In order to develop maximum strength, the "ideal" piece of training equipment would provide:

1. Resistance throughout the range of movement;
2. Matching variable resistance; that is, resistance that varies in accordance with the strength curve for that particular exercise movement.

Resistance Curve of Steel Springs and Rubber Cables: Steel springs and rubber cables offer increasing resistance as they are progressively stretched through the full range of an exercise movement. This pattern of resistance increase is appropriate for "pressing" exercises because the strength curve for pressing increases from start to finish. However, in "rowing" exercise motions, increasing resistance pattern is inappropriate because the strength curve for "rowing" descends from start to finish. Thus, too little resistance is offered at the beginning of the motion and too much is offered at the end of the movement.

The exercise range of motion varies noticeably with different exercise movements and body parts; for example, leg exercises, specifically with the trainee lying in a "supine" position. The inherent disadvantage of training with springs and cables is that the more they stretch through a full exercise range of motion, the exercise resistance becomes increasingly inappropriate for many exercise movements.

Spring Resilience: Springs provide increasing resistance as they are stretched from start to finish in a particular exercise movement. They have a recommended stretch capacity, and when used improperly, they lose their resilience, may break during use, and shorten their expected life. Over-stretching of the springs during exercise is common with the readily available exercise devices, especially during leg exercise movements, performed from a lying position and also in standing movements that incorporate two (2) movements into one (1) (upper body and lower body movement). As mentioned previously, the tension curve provided by spring resistance is inappropriate for many exercise movements. Over-stretching the springs creates faulty exercise technique because the muscles cannot match the resistance provided by the springs.

Manufacturers of Pilates equipment address these challenges by providing an extra set of long cables and also extension straps to prevent cable over-stretching. The problem is that the long cables and the extension straps cannot properly accommodate all of the different limb lengths and body sizes of the people using the equipment.

The Dual Balance Adjustable Spring Tower of the present invention solves these problems in an innovative manner. The Dual Balance Spring Tower assembly is an improvement over the present art and solves several design shortcomings in the above-mentioned conventional Pilates exercise equipment. The Dual Balance Spring Tower comprises a vertically adjustable and movable spring carriage that provides immediate spring tension with sufficient "gradual" resistance progressions through a full range of exercise motion for all exercise movements.

SUMMARY OF THE INVENTION

The exercise assembly of the present invention comprises a Dual Balance Spring Tower apparatus, wherein said apparatus comprises a vertically adjustable and moveable carriage that houses one to five (1-5) detachable steel spring members. Said spring members are color coded to indicate resistance level. The same combination of springs are used for both upper body (arms) and lower body (legs). Said springs are vertically positioned in the carriage and attached to a top plate member, which glides vertically along two (2) guide rods.

The springs are identified by color as: (1) very light; (2) light; (3) medium; (4) heavy; and (5) very heavy. A user, or trainee, can use one spring by both upper body limbs and both lower body limbs. There is no need (as in the Pilates Tower™ and Springboard™ equipment) to have two separate springs for the upper body and two separate springs for the lower body. The trainee can start with only one spring or use a combination of springs as needed for progressions in order to gradually increase strength or match the starting strength of the trainee.

In the preferred embodiment, the present invention comprises a bilateral exercise machine having a frame, a vertically adjustable and moveable spring carriage assembly, and dual cable and pulley linkage assemblies attached to said spring assembly. Said cable and pulley linkage assemblies are independent of one another; that is, such cable and pulley linkage systems are oriented in a manner that splits resistance from said spring assembly into two equal halves, with fifty (50%) percent resistance for each limb during bilateral exercise performance. In the preferred embodiment, even though said dual cable and pulley linkage assemblies are separate and independent from each other, such parallel linkage assemblies are attached to the same spring assembly (and not to multiple spring assemblies).

The dual balance cable and pulley design splits the total resistance of one spring or a combination of springs equally for both limbs; 50% for one limb and 50% for the other limb. Thus, the work needed to perform the exercise movement by the two limbs working simultaneously is shared equally. The total resistance can be provided by one spring or a combination of the five springs. The dual balance cable and pulley design also allows the trainee to use one limb at a time to perform an exercise movement.

Because such cable and pulley linkage assemblies of the present invention operate independently from each other, a user immediately receives an indication if one limb (arm or leg) is contributing more effort than the other limb during bilateral exercise. Such indication includes, without limitation, a cable on the "weaker" side becomes slack, and a user seeing that the force being exerted simultaneously by the two limbs during bilateral exercise is "off-balance."

The Dual Balance Spring Tower assembly with its unique spring carriage design can accommodate trainees with either a very low starting strength or a high level starting strength. Additionally, the multiple spring resistance combinations take into account that some muscles are either weaker or stronger than other muscle groups. One constant resistance for all muscle groups does not address this muscle strength variance.

The Dual Balance Spring Tower assembly of the present invention provides gradual progressions of resistance needed to enhance an individual's strength potential. It prepares the individual to carry out real-life demands at work, play, sports or in everyday activities in a safe and efficient manner. It enables a trainee to perform a variety of exercise movements using a single limb or both limbs simultaneously of both the upper and lower body. It allows the trainee to do exercises from a variety of body positions: lying (supine, prone, side); sitting (cross-legged, legs straight); kneeling (with hips and glutes on heels and with hips elevated) and quadruped.

However, the main body position that the Dual Balance Spring Tower assembly of the present invention addresses is standing. The amount of force generated by the body is affected by the strength of the "bracing" of the core (abdominals, low back, hips) and how stable the body position is during exertion. Sitting and kneeling positions do not place the body in a stable position needed to maximize the trainee's strength potential for many exercise movements or prepare the body well for improving standing movements. An important exercise goal is to improve stabilization and core contribution during exercise performance in a standing position.

There are no "dead" spots (lack of tension) in the springs with the Dual Balance Spring Tower assembly during exercise performance. To maximize the strength training effects on the working muscles during exercise performance, there should be constant tension placed on the muscles throughout the full range of exercise motion. The Dual Balance adjustable vertical spring carriage enables the trainee to be closer to the spring tower training apparatus during exercise performance. There is an immediate and continuous tension placed on the working muscles throughout the full range of exercise motion regardless of the body position.

The Dual Balance assembly comprises a plurality of vertical columns, wherein said vertical columns allow a plurality of pulley housings to be positioned in thirty (30) different anchor points for each limb. This variety of angles of resistance offers a greater stimulation to specific "regions" of a muscle group. The ability to target specific areas of a muscle group can correct muscle imbalances, "sculpt" the body and increase strength. For example, the upper back consists of latissimus dorsi ("lats"), trapezius ("traps"), teres major, and erector spinae ("erectors"). They should all be trained equally in an effective resistance training system.

In a preferred embodiment, the exercise assembly of the present invention comprises a vertically moveable and adjustable spring carriage assembly that enables the user to perform all upper and lower body exercise movements without the need for additional long springs or attaching additional extensions to the exercise handles. The innovative design of the Dual Balance vertically adjustable spring carriage assembly prevents over-stretching of the steel springs, increases exercise ease of use, and matches more closely the tension curve of the steel springs to the strength curve of the muscles being worked. The innovative design of the present invention allows trainees of all sizes and limb lengths to adjust the cable length by simply moving the carriage vertically and locking it into place on two spring alignment rails.

The Dual Balance vertically adjustable spring carriage assembly of the present invention comprises a top guide plate and a bottom anchor plate that are separated by two spacers or sleeves. The bottom anchor plate is designed to lock into place vertically on the two spring alignment rails. One end of the steel springs is attached to the top guide plate, and the other end of the steel springs is attached to the bottom anchor plate. The distal end of the spring that is attached to the bottom anchor plate remains fixed as the spring is stretched during exercise performance. The top end of the spring, which is attached to the top guide plate, moves with the top guide plate in a vertical direction on the spring alignment rails as the spring is being stretched during the exercise performance.

The position of the carriage on the spring alignment rails determines the length of the cables available to the trainee. As the vertically adjustable spring carriage is moved upward along the spring alignment rails, the cables will increase in length accordingly. When the bottom anchor plate is locked into place, the cable length is set accordingly.

In a further embodiment, the exercise assembly of the present invention comprises a tilt platform that enables a user to receive "real-time" visual feedback during exercise performance. Such tilt platform further stimulates both sides (limbs) of a user's body during exercise and dynamically activates balancing mechanisms that require a user to coordinate both sides of the body in order to balance the resistance that is being pulled.

Said tilt platform is more responsive and sensitive to the uneven contribution of each limb to force exertion during bilateral exercise. Due to its sensitivity, the tilt platform provides the user "real-time" biofeedback via force output and constantly challenges the user to keep the platform from tilting. Ultimately, the goal is to keep the platform in a horizontally level position (i.e., parallel to the top plate of the spring carriage) during bilateral exercise performance. Additionally, by utilizing said tilt platform, the integrated benefits to a user during exercise performance will be substantially greater by way of challenging a user's kinesthetic system, which provides that person with a sensory awareness of the position and movements of his or her body.

Even though the springs are "guided" in a linear manner with guide rods, the tilt platform is dynamic, thus constantly giving feedback to the user via force output and challenging said user to make any necessary adjustments in order to keep said tilt platform in a relatively horizontal position. As a result, the tilt platform requires balance and an increased mind-body connection, as well as an improved neuro-muscular function. By focusing on keeping the tilt platform in a relatively horizontal position (i.e., parallel to the top plate of the spring assembly), the user (1) has "real-time" visual feedback due to the sensitivity and response of said tilt platform; and (2) is forced to make any necessary adjustments, and as a result, can engage the mind to focus on controlling the speed of the exercise movement, thereby enabling the nervous system to develop a better muscle/strength balance.

Thus, the tilt platform allows a user to visually see which limb is contributing more or less output, or effort, during bilateral training. For example, if the left limb is exerting more force, the left side of the tilt platform will lift in a relatively upward direction and the right side of the tilt platform will drop or tilt in a relatively downward direction, thereby indicating that the right limb is not contributing as much effort as the left limb. By constantly adjusting the force that is exerted by the limbs during exercise performance to make them equal, the user will be able to train the brain and nervous system and to train the muscles to perform equally, thereby correcting strength imbalance between two limbs.

Through visual feedback, a user can now turn strength "imbalance" between two limbs into "balance" by way of lifting with both limbs relatively equally during exercise performance. The user will be able to learn not to lead with a dominant side, but rather to use both limbs equally and evenly during bilateral training. As a result, when there is a dual balance between the two limbs, which is represented by two independent (separate) cables working together during bilateral exercise, there is no longer a force output or tension imbalance due to strength imbalance.

The dual balance exercise assembly of the present invention permits a user to work both sides of the body in a coordinated, dynamic manner using bilateral strength or resistance training. In addition to other benefits, such balanced training and said tilt platform can also significantly improve physical therapy outcomes and training outcomes. By challenging a user's nervous system, muscles and connective tissues work together to achieve balanced effort. As a result, a user's body is able to learn how to strengthen the weaker side of the body by integrating and strengthening the mind-body connection.

While the present invention is described with reference to preferred embodiments, it will be understood by those skilled in the art that various changes may be made and equivalents may be substituted for elements thereof without departing from the scope of the present invention. In addition, many modifications may be made to adapt a particular situation or material to the teachings of the invention without departing from the essential scope thereof. Therefore, it is intended that the present invention not be limited to the particular embodiments disclosed as the best mode contemplated for carrying out this invention, but that the invention will include all embodiments (and legal equivalents thereof).

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
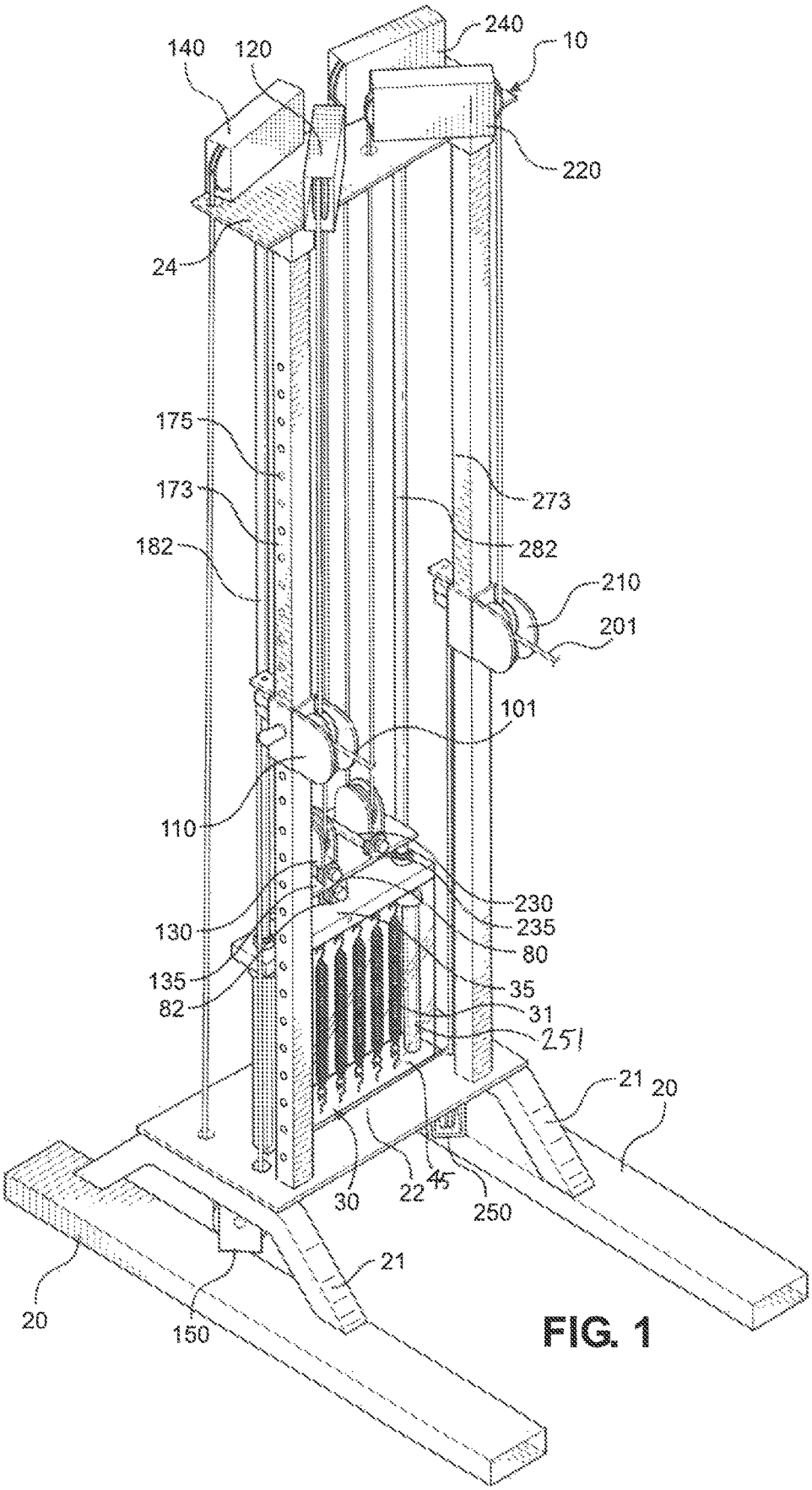
FIG. 1 depicts a perspective view of a preferred embodiment of a spring tower exercise assembly equipped with a dual balance system and a vertically adjustable spring carriage of the present invention.

FIG. 1 depicts a side perspective view of exercise assembly 10 equipped with a dual balance system and a vertically adjustable spring carriage of the present invention in a bottom position. In a preferred embodiment, the present invention includes a base assembly comprising lower base members 20, parallel base support members 21, and lower frame support member 22 extending between said base support members 21. Said base assembly should beneficially provide a stable and secure foundation for exercise assembly 10, particularly during exercise performance by a user.

Left vertical frame column member 173 and right vertical frame column member 273 extend upward from said base assembly. In a preferred embodiment, said vertical frame column members 173 and 273 are oriented substantially vertically and parallel to each other. Further, each of said vertical frame column members 173 and 273 can include a plurality of space-apart transverse bores 175 and 275, respectively; said bores 175 and 275 are beneficially spaced apart at desired intervals. Cap member 24 is disposed on the upper ends of said substantially vertical and substantially parallel frame members 173 and 273. In addition, cap member 24 is disposed on the upper ends of substantially vertical and substantially parallel spring carriage alignment rails 182 and 282.

Still referring to FIG. 1, vertically adjustable spring-loaded carriage assembly 30 is positioned within said exercise assembly 10. Although said spring assembly 30 can be placed in any number of different vertically oriented locations without departing from the scope of the present invention, in the preferred embodiment, said spring assembly 30 is beneficially positioned on or about lower frame support member 22 and centered between parallel vertical frame column members 173 and 273. Spring assembly 30 comprises left spring alignment rail 182 and right spring alignment rail 282. Said spring alignment rails 182 and 282 are disposed on lower frame support member 22 and extend from lower frame support member 22 to cap member 24. Further, spring carriage alignment rails 182 and 282 beneficially guide a plurality of springs 31 during exercise and support a top guide plate member 35 of a tilt platform 80, a plurality of spring alignment rail sleeves 151 and 251, and a bottom anchor plate 45. Parallel linkage assemblies, comprising left cable 101 and right cable 201, and a plurality of pulley assemblies discussed in more detail below, is disposed on and/or around said support frame members of exercise assembly 10, and connected to spring assembly 30.

Spring assembly 30 comprises tilt platform 80 attachably connected to and relatively evenly balanced in a center position on the top guide plate 35. Rotatable connecting bolt 82 allows tilt platform 80 to substantially "tilt" or lean from side to side during exercise performance. Tilt platform 80 supports left tilt platform pulley assembly 130 and right tilt platform pulley assembly 230, wherein both tilt platform pulley assemblies 130 and 230 are mounted on rotatable mounting pins 135 and 235 that enable tilt platform pulley assemblies 130 and 230 to lean from side to side during exercise performance.

As depicted in FIG. 1, left cable 101 extends through left adjustable pulley assembly 110, over left upper front pulley assembly 120, under left tilt platform pulley assembly 130, over left upper rear pulley assembly 140 and under left lower pulley assembly 150. Left cable 101 is anchored to left adjustable pulley assembly 110. Similarly, right cable 201 extends through right adjustable pulley assembly 210, over right upper front pulley assembly 220, under right tilt platform pulley assembly 230, over right upper rear pulley assembly 240 and under right lower pulley assembly 250. Although not visible in FIG. 1, right cable 201 is anchored to right adjustable pulley assembly 210.

Left cable 101 and right cable 201 are two separate cables that are separately connected to spring assembly 30 by way of connecting to the top of tilt platform 80. As a result, when left cable 101 and right cable 201 are separate and independent from one another, but are working together in order to lift a load, any "uneven" contribution of force exerted by the limbs working simultaneously in a bilateral motion will be indicated in the cable tension during exercise performance, wherein said "uneven" contribution can be viewed by the position of tilt platform 80 in relation to the top guide plate 35 of spring assembly 30. Thus, when both limbs contribute force evenly, tilt platform 80 will be in a substantially horizontal position and relatively parallel to the top guide plate 35 of spring assembly 30.

Figure 2:
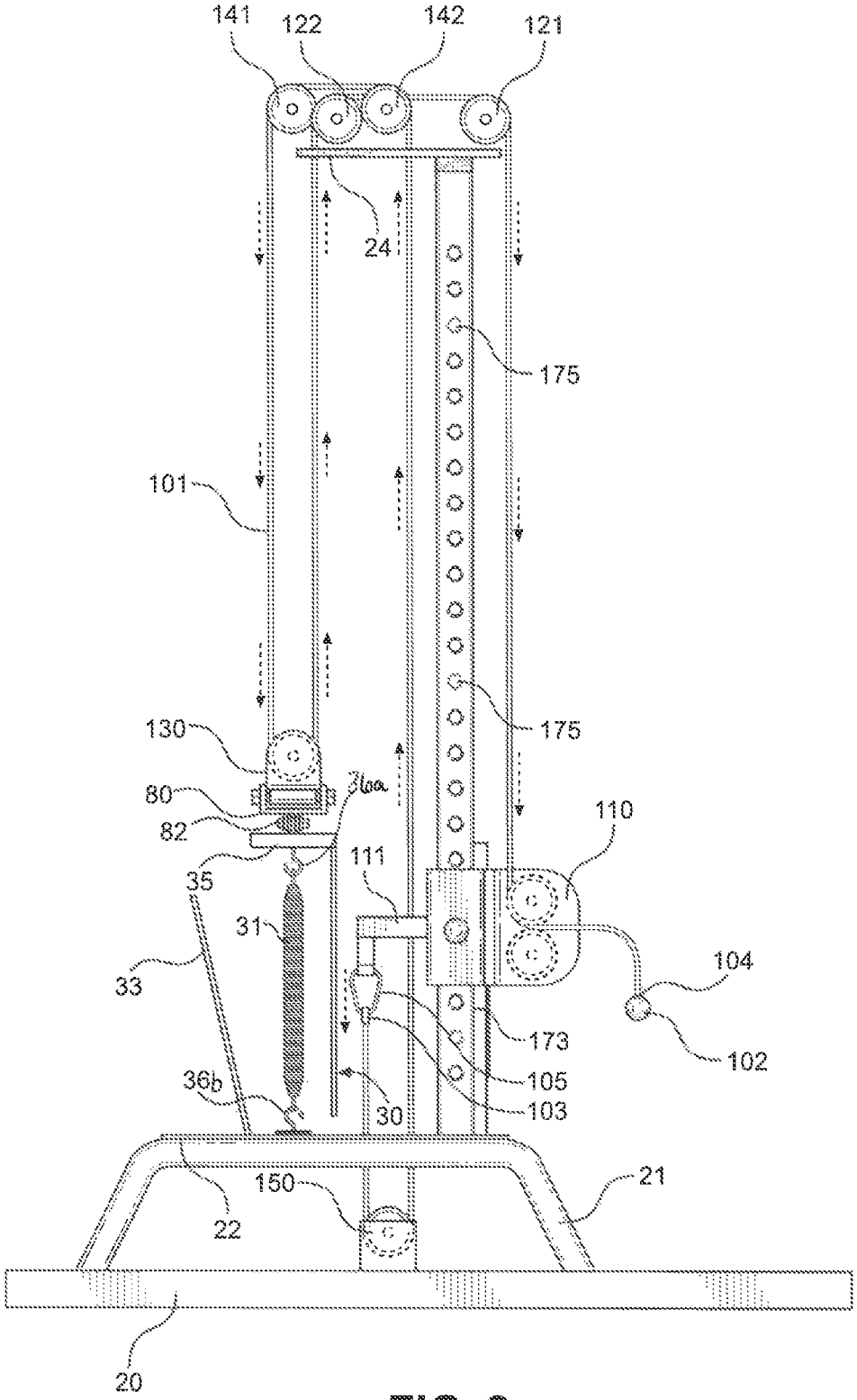
FIG. 2 depicts a first (left) side view of a preferred embodiment of a spring tower exercise assembly equipped with a dual balance system and a vertically adjustable spring carriage of the present invention.

FIG. 2 depicts a first (left) side view of an exercise assembly 10 equipped with a dual balance system and a vertically adjustable spring carriage of the present invention. It is to be noted that while an opposite (right) side view of said exercise assembly 10 is not illustrated in FIGS. 1-7 herein, said opposite (right) side view of said exercise assembly is to mirror the image depicted in FIG. 2. A base assembly comprises lower base members 20, base support members 21, and lower frame support member 22, and provides a stable and secure foundation for exercise assembly 10.

Left vertical frame member 173 and right vertical frame member 273 extend upward from said base assembly. Said left and right vertical frame members 173 and 273 are oriented substantially vertically and include a plurality of spaced-apart transverse bores 175 and 275. Said bores 175 and 275 can be beneficially spaced apart at desired intervals. Cap member 24 is disposed on the upper ends of said substantially vertical and substantially parallel left and right frame members 173 and 273.

Vertically adjustable spring loaded carriage assembly 30, which comprises steel spring resistance for training, is positioned within said exercise assembly 10. In a preferred embodiment, said spring assembly 30 comprises a plurality—typically five (5)—of steel spring members 31. Said spring members 31 can be combined in a number of different variations in order for a user to quickly and efficiently select a desired level of resistance to be pulled by adjusting the particular spring members 31 that are being used. Moreover, spring loaded carriage assembly 30 comprises a storage spring rack 33 in order to hold and store springs 31 that are not in use. Storage spring rack 33 is beneficially positioned on or about lower frame support member 22, centered between parallel vertical frame column members 173 and 273, and beneficially positioned in front of spring-loaded carriage assembly 30 for easy accessibility to said springs 31.

As depicted in FIG. 2, left adjustable pulley assembly 110 is slidably disposed along a portion of the length of left vertical frame member 173. Similarly, although not depicted in the Figures, right adjustable pulley assembly 210 is slidably disposed along a portion of the length of right vertical frame member 273. Left cable 101 and right cable 201 are disposed on and/or around said support frame members of exercise assembly 10 through a system of pulleys and connected to tilt platform 80 and spring assembly 30.

Left cable 101 extends through left adjustable pulley assembly 110, over pulleys 121 and 122 of left upper front pulley assembly 120, under left tilt platform pulley assembly 130, over pulleys 141 and 142 of left upper rear pulley assembly 140 and under left lower pulley assembly 150. Distal end 103 of left cable 101 is anchored to bracket member 111 of left adjustable pulley assembly 110; the position of left adjustable pulley assembly 110 can be selectively adjusted relative to left vertical frame member 173.

Figure 3:
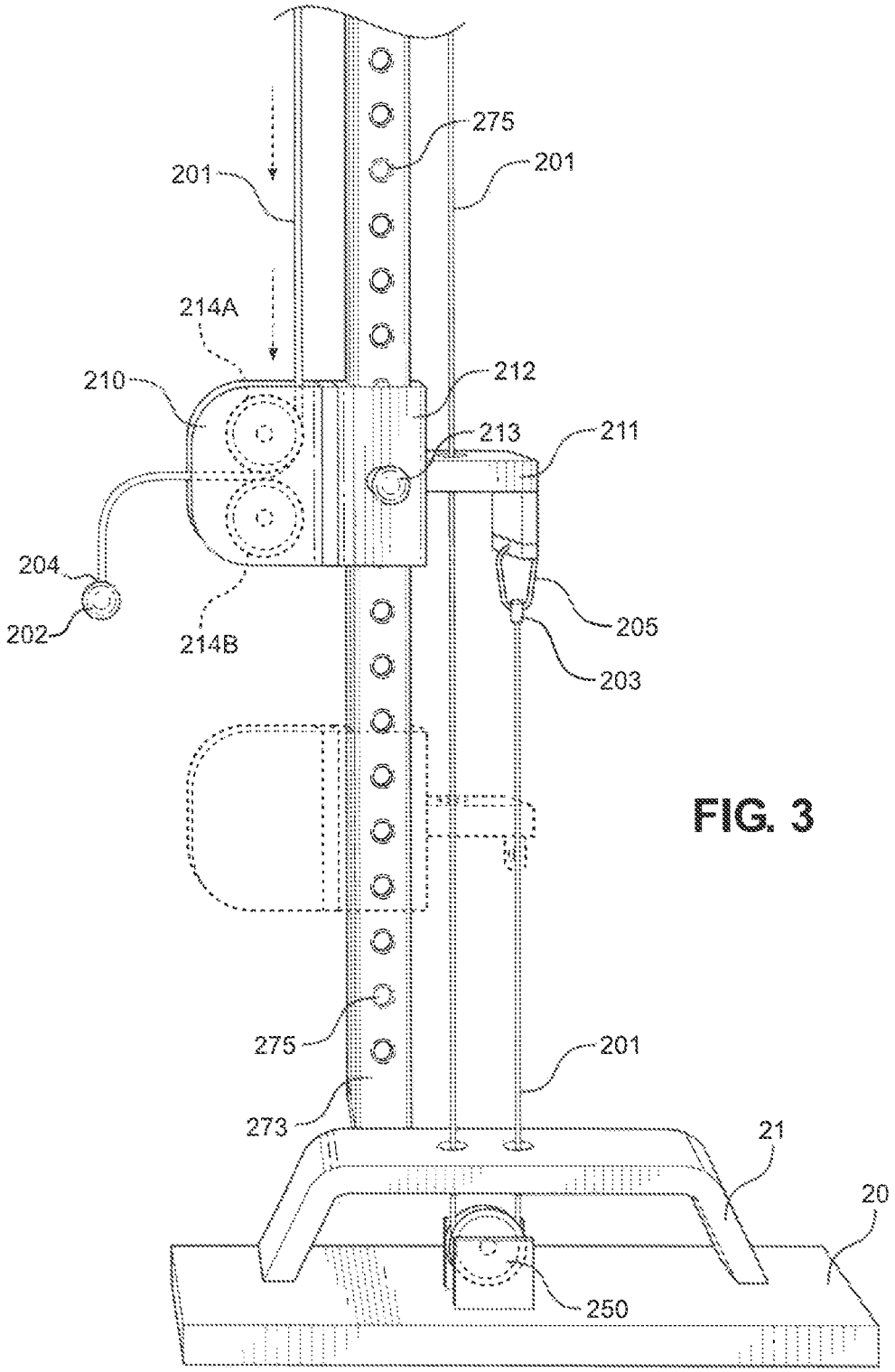
FIG. 3 depicts a detailed side view of a preferred embodiment of a portion of a vertical frame column member and right adjustable pulley and linkage assembly of the present invention.

Although not depicted in the Figures herein, right cable 201 extends through right adjustable pulley assembly 210, over pulleys 221 and 222 of right upper front pulley assembly 220, under right tilt platform pulley assembly 230, over pulleys 241 and 242 of right upper rear pulley assembly 240 and under right lower pulley assembly 250. As depicted in FIG. 3, distal end 203 of right cable 201 is anchored to bracket member 211 of right adjustable pulley assembly 210; the position of right adjustable pulley assembly 210 can be selectively adjusted relative to right vertical frame member 273. A left handle member 102 is attached to proximate end 104 of left cable 101, while right handle member 202 is attached to proximate end 204 of right cable 201.

Still referring to FIG. 2 and FIG. 3, the arrows depict the direction of travel when a user engages in exercise activity using exercise assembly 10. Specifically, the arrows on FIG. 2 depict the travel direction of left cable 101 when a user pulls on left handle 102 with left limb. Similarly, the arrows on FIG. 3 depict the direction of travel of right cable 201 when a user pulls on right handle 202 with right limb.

FIG. 3 depicts a detailed side view of a portion of a right vertical frame column member 273 and right adjustable pulley assembly 210 and linkage assembly of the present invention. Right cable 201, having handle member 202 attached at proximate end 204, extends through pulleys 214 of right adjustable pulley assembly 210. Right adjustable pulley assembly 210 has housing section 212 slidably disposed on right vertical column member 273. Said housing section 212 can be selectively secured in place using adjustment pin 213, which can be received within transverse bores 275. (Although not visible in FIG. 3, said right cable 201 extends over pulleys 221 and 222 of right upper front pulley assembly 220, under right tilt platform pulley assembly 230, over pulleys 241 and 242 of right upper rear pulley assembly 240 and under right lower pulley assembly 250).

Distal end 203 of right cable 201 is anchored to bracket member 211 of right adjustable pulley assembly 210 which, in turn, can be adjustably positioned relative to right vertical frame member 273.

Figure 4:
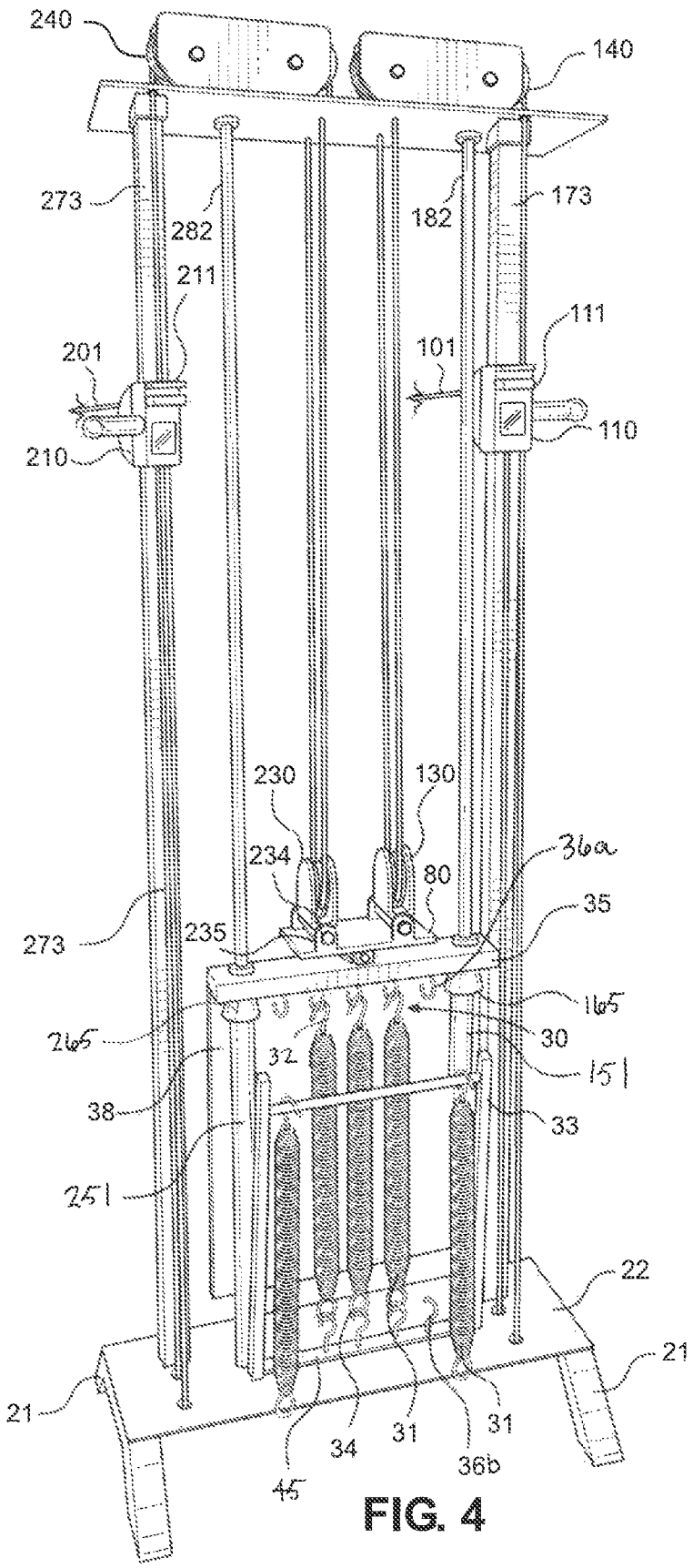
FIG. 4 depicts a rear perspective view of a preferred embodiment of a spring tower exercise assembly equipped with a dual balance system and a vertically adjustable spring carriage of the present invention locked in a bottom position.

FIG. 4 depicts a rear view of exercise assembly 10 equipped with a dual balance system and vertically adjustable spring carriage 30 of the present invention in a bottom position. A base assembly comprises a lower base assembly. Said lower base assembly depicted in FIG. 4 is slightly different than the base assembly illustrated in FIGS. 1 through 3 to illustrate that the specific design of said base assembly is generally not essential to the function of exercise assembly 10, so long as said base assembly provides a stable and secure foundation for such exercise assembly 10. Vertical frame members 173 and 273 extend upward from said base assembly. Said vertical frame members 173 and 273 are oriented substantially vertically and parallel to each other and include a plurality of spaced-apart transverse bores 175 and 275. Cap member 24 is disposed on the upper ends of said substantially vertical frame members 173 and 273 and on the upper ends of said substantially vertical spring pulley assembly 130.

Vertically adjustable spring loaded carriage assembly 30 comprises a plurality of centrally positioned and equidistantly spaced apart spring members 31. Left adjustable pulley assembly 110 is slidably disposed on left vertical frame member 173, while right adjustable pulley assembly 210 is slidably disposed on right vertical frame member 273. A linkage assembly having independently functioning left cable 101 and right cable 201 is disposed on and around said support frame members of exercise assembly 10 (including, without limitation, over left upper rear pulley assembly 140 and right upper rear pulley assembly 240), and connected to tilt platform 80.

Vertically adjustable spring loaded carriage assembly 30 comprises a storage spring rack 33 in order to hold and store springs 31 that are not in use. Storage spring rack 33 is beneficially positioned on or about lower frame support member 22, centered between parallel vertical frame column members 173 and 273, and beneficially positioned behind said spring loaded carriage assembly 30 for easy accessibility to said springs 31.

Figure 5:
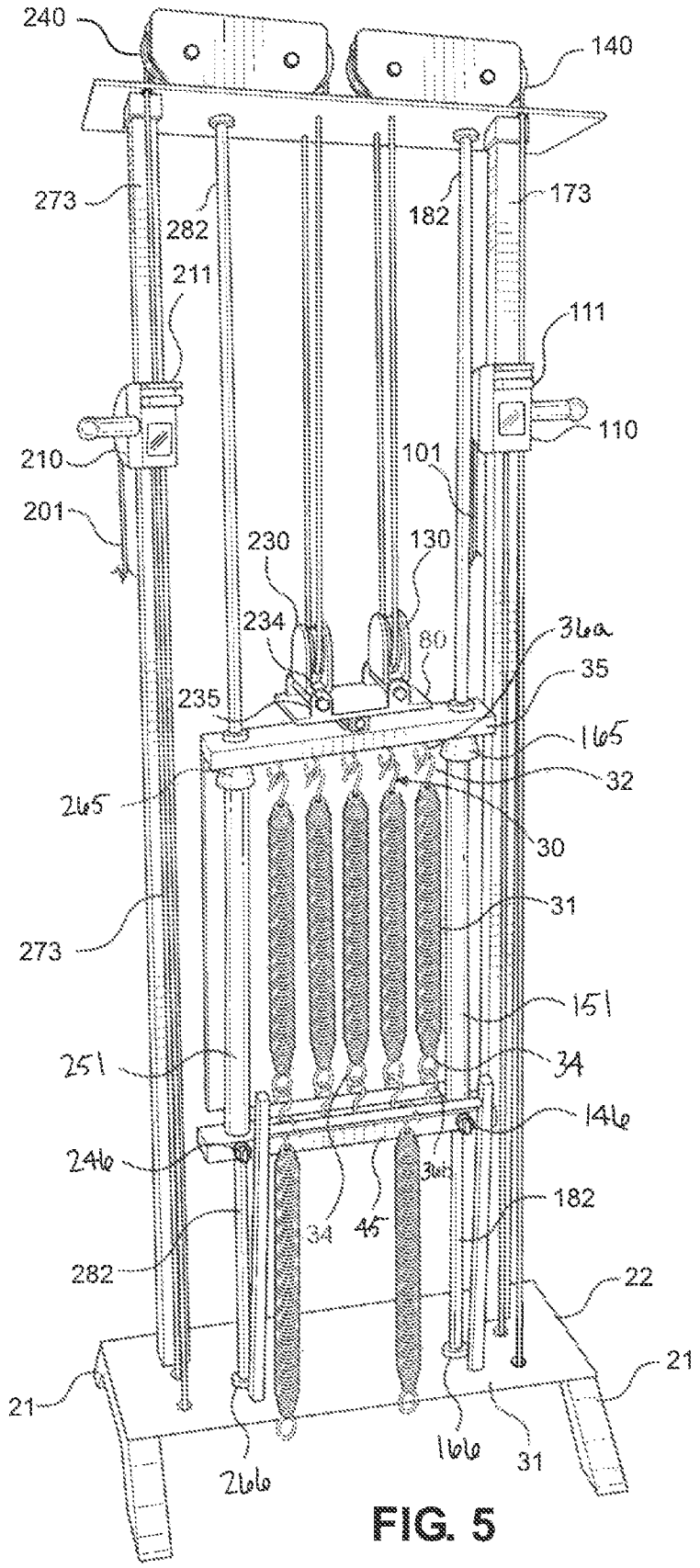
FIG. 5 depicts a rear perspective view of a preferred embodiment of a spring tower exercise assembly equipped with a dual balance system and a vertically adjustable spring carriage of the present invention locked in a raised position.

FIG. 5 depicts a rear perspective view of exercise assembly 10 equipped with a dual balance system and vertically adjustable spring carriage 30 of the present invention locked in a raised position. Although not depicted in FIG. 5, storage spring rack 33 is affixed to a top of lower frame support member 22, as illustrated in FIG. 4. Referring back to FIG. 4, when the vertically adjustable spring carriage assembly 30 is in a bottom position, affixed on a top of lower frame support member 22, the proximal ends of cables 101 and 201, along with handle members 102 and 202, are positioned in close proximity to adjustable pulley assemblies 110 and 210, respectively.

Referring to FIG. 5, when vertically adjustable spring carriage assembly 30 is raised vertically along spring alignment rails 182 and 282 and locked into place with twist lock fasteners 146 and 246, the proximal ends of cables 101 and 201, along with handle members 102 and 202, drop (lower) downward and away from adjustable pulley assemblies 110 and 210, respectively. By adjusting the fixed position of the spring carriage 30, a user can determine how close or how far the handle members 102 and 202 are located in relation to the adjustable pulley assemblies 110 and 210.

The ability to adjust the usable cable lengths 101 and 201 by the user offers several advantages, including but not limited to: (1) prevention of over-stretching of steel springs during exercise use which affects the resilience and life of the springs; (2) tension (resistance) curve of the steel springs approximates the strength curve of the working muscles during many exercise movements; (3) ease of use—the user can get into starting exercise position and perform exercise movements with greater ease, efficiency, and safety; (4) there are no dead spots (no tension) anywhere in the full range of motion during exercise performance; (5) there is no need for extra attachments or extensions for hands or feet to perform certain exercise movements; and (6) the ability to adjust cable length takes into account different body sizes and limb lengths of the users.

Figure 6:
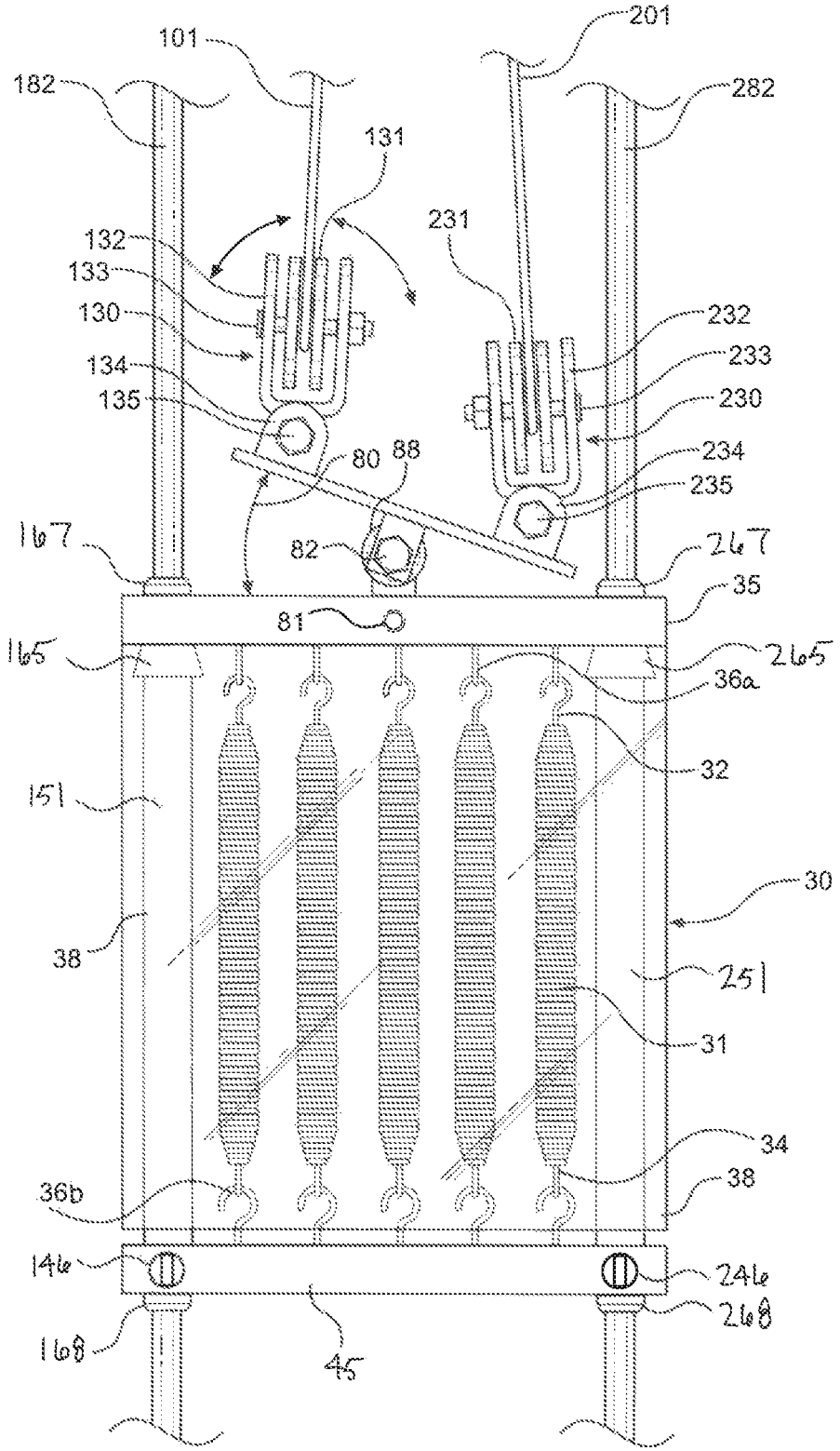
FIG. 6 depicts a front view of a preferred embodiment of a spring tower with pulley assemblies, a tilt platform, and a vertically adjustable spring carriage in accordance with the dual balance system of the present invention.

FIG. 6 depicts a front view of vertically adjustable spring loaded carriage assembly 30 with tilt platform 80 attached to top guide plate member 35 via a connecting rotatable mounting pin 82. Further, spring assembly 30 comprises left and right tilt platform pulley assemblies 130 and 230 attached to tilt platform 80 in accordance with the dual balance system of the present invention.

In the preferred embodiment, spring assembly 30 comprises a plurality of spring members 31 that permit a variety of different resistance levels to be pulled and utilized. Spring loaded carriage assembly 30 further comprises a face plate member 38, wherein said face plate member 38 can generally be manufactured from a clear, plastic material. Said exercise assembly 10 comprises an adjustable spring carriage 30 that can be positioned (or locked into position) or re-positioned anywhere along said alignment rails 182 and 282. Said adjustable spring carriage 30 comprises top guide plate member 35, rubber cushion members 165 and 265, and spring alignment rail sleeves 151 and 251, which are positioned between top guide plate 35 and bottom anchor (support) plate 45. The spring alignment rail sleeves 151 and 251 are not connected or attached to said top guide plate 35 or said anchor plate 45. Said spring alignment rail sleeves 151 and 251 are used to separate top guide plate 35 and bottom anchor plate 45 in order for a carriage to be formed as one single unit. Said carriage support plate (anchor plate) 45 is not fixed to base 22 of said exercise frame—said anchor plate 45 is part of said moveable and adjustable spring carriage assembly 30.

Vertically adjustable spring carriage assembly 30 comprises top guide plate member 35 that is attachably connected to tilt platform 80 via center rod connecting pin 81 and rotatable connecting bolt 82. Moreover, top guide plate member 35 comprises top guide plate bushings 167 and 267 for ease of movement of top guide plate 35 along spring alignment rails 182 and 282 during use. Top guide plate member 35 further comprises a plurality of eye bolts **36*a* that connect a first end 32 of resistance springs 31 to top guide plate member 35. Moreover, second end 34 of resistance springs 31 connects to a plurality of eye bolts 36*b* that are fastened to a top surface of bottom anchor plate 45. When springs 31 are connected to top guide plate 35 and bottom anchor plate 45, said springs 31** are ready to be used.

Bottom anchor plate member 45 comprises a plurality of eye bolts **36*b*, bottom anchor plate bushings 168 and 268 for ease of movement of bottom anchor plate 45 along spring alignment rails 182 and 282 during use in order to lock into a selected position. Furthermore, bottom anchor plate 45 comprises two twist lock fasteners 146 and 246 that enable a trainee to lock and unlock bottom anchor plate 45 to spring alignment rails 182 and 282, as needed, thereby being able to position or re-position vertically moveable carriage assembly 30 anywhere along alignment rails 182 and 282. The position of vertically adjustable spring carriage assembly 30 on spring alignment rails 182 and 282** determines the cable length available for exercise use.

Said bottom anchor plate 45 also houses five eye bolts **36*b*, which maintain the springs 31 in a fixed position as they are stretched by the moving top guide plate 35 during exercise performance. Spring alignment rail sleeves 151 and 251 act as spacers and thus remain in place on top of the fixed bottom anchor plate 45, while top guide plate 35 moves vertically up and down, thereby stretching the springs 31** during exercise performance.

During exercise use, bottom anchor plate 45 is locked into position on a selected spot along spring alignment rails 182 and 282. Top guide plate 35 moves up and down vertically along spring alignment rails 182 and 282 during exercise use. The steel springs 31 attached to eye bolts **36*a* on top guide plate 35 are stretched upwards during exercise use. The second end of resistance springs 34 attached to eye bolts 36*b* remain stationary, along with bottom anchor plate 45, which is locked into place by twist lock fasteners 146 and 246 on left spring alignment rail 182 and right spring alignment rail 282**.

In the bottom resting position, bottom anchor plate 45 rests on lock collar 166 for left spring alignment rail 182 and lock collar 266 for right spring alignment rail 282, as illustrated in FIG. 5. This creates a space between the bottom side of anchor plate 45 and surface of frame support member 22. A user or trainee simply places his or her hand under bottom anchor plate 45, which also acts as a support base for vertically adjustable spring carriage 30. Said trainee lifts spring carriage assembly 30 vertically into a desired position on spring alignment rails 182 and 282 for exercise use. Twist lock fasteners 146 and 246 lock and unlock bottom anchor plate 45 to spring alignment rails 182 and 282. (It is to be observed that lock collars 166 and 266 for alignment rails 182 and 282 are not visible in FIG. 6). Bottom anchor plate 45 also serves as a support plate for the activated (working) springs 31, spring alignment rail sleeves 151 and 251, rubber cushions 165 and 265, top guide plate 35, tilt platform 80, and tilt platform assemblies 130 and 230.

Further, vertically adjustable spring carriage assembly 30 comprises a left spring alignment rail sleeve 151 mounted on left spring alignment rail 182, a right spring alignment rail sleeve 251 mounted on right spring alignment rail 282, wherein said spring alignment rail sleeves 151 and 251 are positioned and resting on top side of bottom anchor plate 45. The bottom end of spring alignment rail sleeves 151 and 251 are not affixed or connected by any means such as welding to the bottom anchor plate 45. Top end of spring alignment rail sleeves 151 and 251 support rubber cushions 165 and 265, which act as shock absorbers for top guide plate 35 when it is lowered toward the top of the respective spring alignment rail sleeves 151 and 251. Spring alignment rail sleeves 151 and 251 separate the top guide plate 35 from bottom anchor plate 45 when the spring carriage assembly 30 is both at rest and activated for exercise.

Although not depicted in the Figures herein, spring alignment rail sleeves 151 and 251 each comprise a plurality of internally pressed bushings at a top end and a bottom end for ease of movement when spring assembly is moved vertically along spring alignment rails 182 and 282, and locked into position for exercise use.

In the preferred embodiment, tilt platform 80 is mounted to top guide plate member 35 by means of a rotatable mounting pin 82. Tilt platform 80 comprises clevis mounting bracket 88 having rotatable mounting pin 82. Further, tilt platform 80 supports left tilt platform pulley assembly 130 and right tilt platform pulley assembly 230. Top guide plate member 35 acts as a base or support for tilt platform 80. Additionally, top guide plate member 35 acts as a connector plate for resistance springs 31, which are attachably connected to top guide plate member 35 and bottom anchor plate 45 via a plurality of eye bolts 36. Moreover, top plate member 35 acts as a vertical guide plate for a user during exercise performance.

In addition, in the preferred embodiment, left tilt platform pulley assembly 130 comprises pulley wheel 131 rotatably disposed within pulley housing 132; said pulley wheel 131 is rotatable about pulley axle 133. Pulley housing 132 is mounted to tilt platform 80 using clevis mounting bracket 134 having rotatable mounting pin 135. Mounting pin 135 is rotatable within said clevis bracket 134. Similarly, right tilt platform pulley assembly 230 comprises pulley wheel 231 rotatably disposed within pulley housing 232; said pulley wheel 231 is rotatable about pulley axle 233. Pulley housing 232 is mounted to tilt platform 80 using clevis mounting bracket 234 having rotatable mounting pin 235. Mounting pin 235 is rotatable within said clevis bracket 234.

Left cable 101 is disposed around left tilt platform pulley wheel 131, while right cable 201 is disposed around right tilt platform pulley wheel 231. It is to be observed that when left cable 101 is taut (such as when said cable is under tension), left tilt platform pulley assembly 130 is in a substantially upright position. In other words, left pulley member 131 is oriented in a substantially vertical plane. Similarly, when right cable 201 is taut (such as when said cable is under tension), right tilt platform pulley assembly 230 is in a substantially upright position. The amount of force exerted by each limb on its respective cable (i.e., left cable 101 for left limb and right cable 201 for right limb) will determine the position of tilt platform 80 in relation to top plate 35 of spring carriage assembly 30. In the start position of the exercise movement, it is necessary to have a sufficient amount of force exerted by each limb on their respective cables in order to place the pulley wheels 131 and 231 in a substantially vertical plane, thus placing tilt platform 80 in a relatively horizontal position.

Further, it is to be observed that tilt platform pulley housings 132 and 232 can rotate about clevis pivot pins 135 and 235, respectively, allowing such mounting means to act as swivel bushings. This rotational ability allows the pulley wheels 131 and 231 to remain substantially vertical during exercise performance, as long as there is a sufficient initial force output along the cables by the limbs.

As such, if a greater upward force is acting upon left tilt platform housing 132, the left side of tilt platform 80 will "raise" in a relatively upward direction and right side of tilt platform 80 will "drop" in a relatively downward direction. This tilt indicates that a left limb is exerting more force than a right limb. Thus, a user, by observing the position of tilt platform 80 during exercise performance, can correct the force output of the limbs in order to place tilt platform 80 in a desired substantially horizontal position. This visual observation by the user in "real time" during exercise performance can train the user's brain and nervous system by means of a visual biofeedback system in order to correct strength imbalance between the left and the right limbs. As a result, over a period of time, the "weak" side can become equal in strength to the "dominant" (strong) side. Both sides will then be able to contribute equally and evenly to the overall strength output during such bilateral exercise performance.

As noted herein, left and right cable and pulley linkage assemblies of exercise assembly 10 are independent from one another; that is, such cables and pulleys split resistance from spring assembly 30 into two equal halves, with fifty (50%) percent resistance for each side (left and right). As such, said resistance from spring assembly 30 is evenly split between a user's left and right limbs during bilateral exercise performance.

Because such parallel left and right cable and pulley linkage assemblies of the present invention operate independently from each other, a user immediately receives an indication if one limb (left or right) is contributing more effort than the other limb during bilateral exercise. Such indication includes, without limitation, a cable on the "weaker" side becoming slack which, in turn, results in tilt platform 80 "tilting" to the weaker side. The user is able to use this visual cue to exert more force with the weaker limb and less force with the stronger limb in order for tilt platform 80 to balance along top plate member 35 in a relatively horizontal position, thereby indicating equal contributions from both limbs.

The biofeedback system of the present invention (including, without limitation, tilt platform 80) enables a user to receive real-time visual feedback during exercise performance. Specifically, said biofeedback system of the present invention provides data to a user to indicate how much each limb is contributing to the overall work effort during bilateral exercise. Further, such biofeedback system of the present invention allows a user to "even out" strength imbalance between the two limbs, and train a user to "lead with the weak side" in order to build strength in said weak side, while decreasing the force output of the dominant side so that said dominant side does not overpower said weak side during bilateral exercise.

Figure 7A:
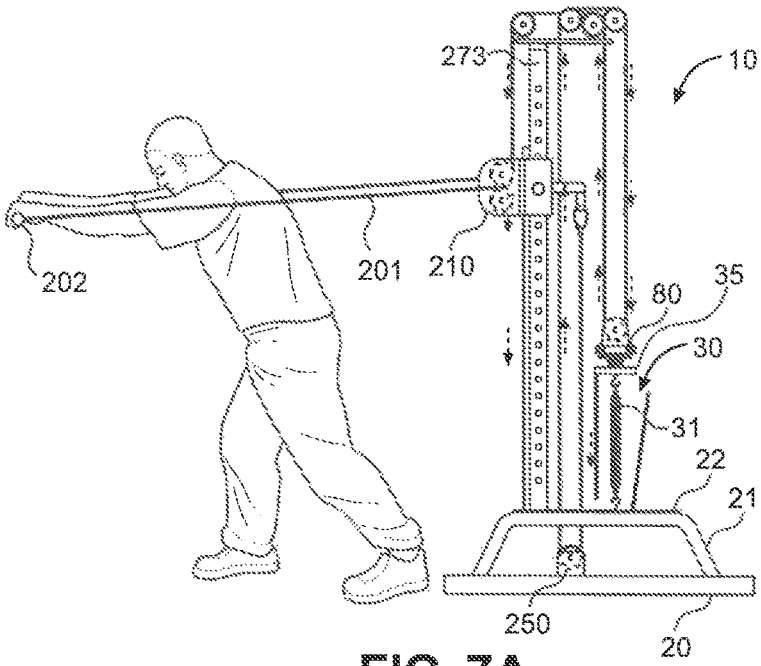
FIG. 7A depicts a side view of a preferred embodiment of a spring tower exercise assembly equipped with a dual balance system and a vertically adjustable spring carriage of the present invention in operation.
Figure 7B:
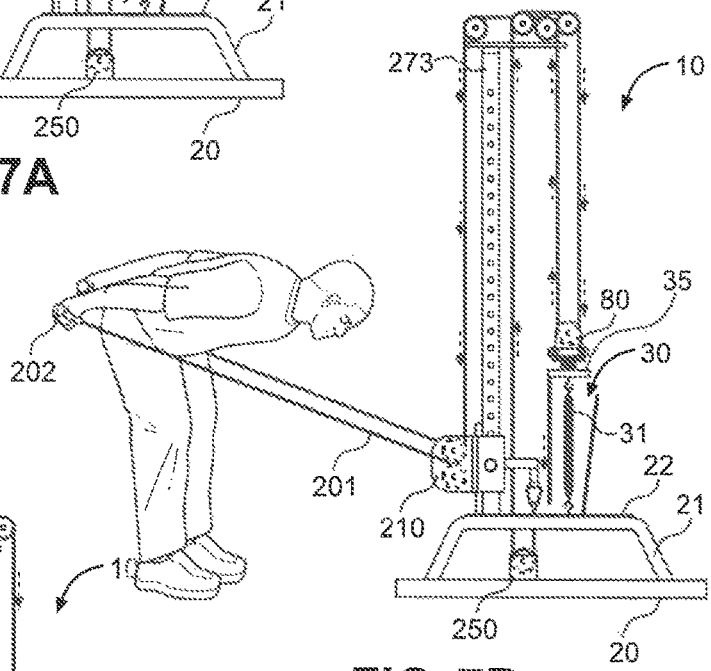
FIG. 7B depicts a side view of a preferred embodiment of a spring tower exercise assembly equipped with a dual balance system and a vertically adjustable spring carriage of the present invention in operation.
Figure 7C:
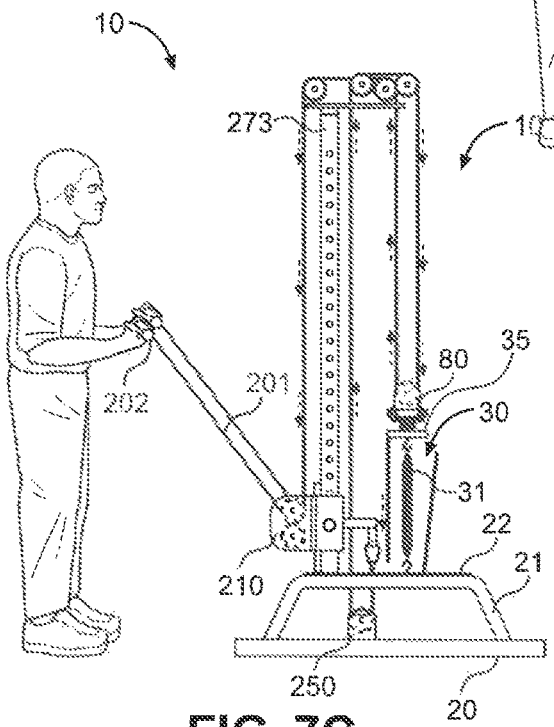
FIG. 7C depicts a side view of a preferred embodiment of a spring tower exercise assembly equipped with a dual balance system and a vertically adjustable spring carriage of the present invention in operation.

FIGS. 7A through 7C depict side views of a user engaging and operating an exercise assembly 10 equipped with the dual balance system of the present invention through multiple different exercise movements. In the preferred embodiment, the exercise assembly 10 of the present invention comprises a spring loaded carriage assembly 30, wherein said spring assembly 30 further comprises a moveable carriage that houses five (5) detachable spring members 31. Said spring members 31 are color coded to indicate resistance level. The same combination of spring members 31 are used for both upper body (arms) and lower body (legs), and said spring members 31 are vertically positioned within said spring carriage assembly 30, which glides vertically along spring alignment rails 182 and 282.

In the preferred embodiment, said cable and pulley linkage systems are oriented in a manner that splits resistance from said spring assembly 30 into two equal halves, with fifty (50%) percent resistance for each limb during bilateral exercise performance. Thus, the work needed by a user to perform the exercise movement by the two limbs working simultaneously is shared equally. The total resistance can be provided by one spring 31 or a combination of the five springs 31. As such, said cable and pulley linkage systems also allow said user to use one limb at a time to perform an exercise movement.

Because such cable and pulley linkage assemblies of the present invention operate independently from each other, said user immediately receives an indication if one limb (arm or leg) is contributing more effort than the other limb during bilateral exercise. Such indication includes, without limitation, a cable on the "weaker" side become slack which, in turn, results in a resistance being off-balance and a user seeing that the resistance being pulled is off-balance.

In the preferred embodiment, the dual balance exercise assembly 10 of the present invention permits a user to work both sides of the body in a coordinated, dynamic manner using bilateral resistance training. In addition to other benefits, such balanced training can also significantly improve physical therapy outcomes. By challenging a user's nervous system, muscles and connective tissues work together to achieve balanced effort. As a result, a user's body learns how to strengthen the weaker side by integrating and strengthening the mind-body connection.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. A vertically standing exercise assembly comprising:

a) a lower frame support member;

b) a cap member;

c) a right cable and pulley linkage assembly and a left cable and pulley linkage assembly;

d) a vertically adjustable spring carriage assembly, wherein said vertically adjustable spring carriage assembly comprises:

i. a top guide plate, wherein said top guide plate is attachably connected to both said right cable and pulley linkage assembly and said left cable and pulley linkage assembly;

ii. a bottom anchor plate, wherein said bottom anchor plate is not fixed to said lower frame support member of said exercise assembly;

iii. a first spring alignment rail sleeve and a second spring alignment rail sleeve, wherein said first spring alignment rail sleeve and said second spring alignment rail sleeve are both attachably connected to and positioned between said top guide plate and said bottom anchor plate;

iv. a plurality of spring members; and, e) a storage spring rack comprising a plurality of additional springs that are not in use, wherein said storage spring rack is positioned on or about said lower frame support member and is positioned in front of said vertically adjustable spring carriage assembly.

2. The vertically standing exercise assembly of claim 1, further comprising a plurality of eye bolts that connect a first end of said plurality of spring members to said top guide plate.

3. The vertically standing exercise assembly of claim 2, further comprising a plurality of eye bolts that connect a second end of said plurality of spring members to said bottom anchor plate.

4. The vertically standing exercise assembly of claim 3, further comprising a right vertical frame column member and a left vertical frame column member, wherein said right vertical frame column member comprises a right adjustable pulley housing of said right cable and pulley linkage assembly and said left vertical frame column member comprises a left adjustable pulley housing of said left cable and pulley linkage assembly, wherein said vertically adjustable spring carriage assembly is positioned on or about said lower frame support member, and said vertically adjustable spring carriage assembly is centered between said right vertical frame column member and said left vertical frame column member.

5. The vertically standing exercise assembly of claim 4, further comprising a left spring alignment rail and a right spring alignment rail, wherein said left spring alignment rail and said right spring alignment rail are both disposed on said lower frame support member and vertically guide said first spring alignment rail sleeve and said second spring alignment rail sleeve of said vertically adjustable spring carriage assembly during exercise.

6. The vertically standing exercise assembly of claim 5, wherein both said top guide plate and said bottom anchor plate of said vertically adjustable spring carriage assembly move up and down vertically along both said left spring alignment rail and said right spring alignment rail in order for a user to reach a desired exercise position for said vertically adjustable spring carriage assembly.

7. The vertically standing exercise assembly of claim 6, further comprising a left fastener and a right fastener that are both positioned on said bottom anchor plate, wherein said left fastener and said right fastener secure said bottom anchor plate of said vertically adjustable spring carriage assembly into place in order for a user to perform a desired exercise movement.

8. The vertically standing exercise assembly of claim 7, wherein said top guide plate moves up and down vertically along said left spring alignment rail and said right spring alignment rails during exercise use by way of a tension force that is applied to at least one of said right cable and pulley linkage assembly and said left cable and pulley linkage assembly that is attachably connected to said top guide plate.

* * * * *